US012674319B2

(12) United States Patent
Kim et al.

(10) Patent No.: US 12,674,319 B2
(45) Date of Patent: Jul. 7, 2026

(54) CONSTRUCTION TEMPLATE

(71) Applicant: Zhaoqing Pansystem International Trade Co., Ltd., Zhaoqing (CN)

(72) Inventors: Gi Hwan Kim, Bucheon-si (KR); Sung Hwan Kim, Bucheon-si (KR)

(73) Assignee: Zhaoqing Pansystem International Trade Co., Ltd., Zhaoqing (CN)

( * ) Notice: Subject to any disclaimer, the term of this patent is extended or adjusted under 35 U.S.C. 154(b) by 284 days.

(21) Appl. No.: 18/432,155

(22) Filed: Feb. 5, 2024

(65) Prior Publication Data

US 2024/0271420 A1 Aug. 15, 2024

(30) Foreign Application Priority Data

Feb. 10, 2023 (CN) ..... 202310111754.3

(51) Int. Cl.

| | |
|---|---|
| ***E04B 5/36*** | (2006.01) |
| *E04B 1/86* | (2006.01) |
| *E04G 9/10* | (2006.01) |
| *E04G 11/36* | (2006.01) |

(52) U.S. Cl.
CPC ..... *E04B 5/36* (2013.01)

(58) Field of Classification Search
CPC ..... E04B 5/36; E04B 1/86; E04B 1/98; E04B 1/14; E04B 1/80; E04B 5/19; E04G 9/10; E04G 11/36
USPC ..... 52/272, 309.13, 483.1
See application file for complete search history.

(56) References Cited

U.S. PATENT DOCUMENTS 947,702 A * 1/1910 Rowley ..... E04G 9/10 249/155
2,156,588 A * 5/1939 Hopewell ..... E04B 5/36 52/378
3,507,738 A * 4/1970 Prusinski ..... B44C 5/04 428/116
3,597,890 A * 8/1971 Hala ..... E04B 1/166 52/444
3,807,106 A * 4/1974 Reinhardt ..... E04B 1/98 52/1

(Continued)

FOREIGN PATENT DOCUMENTS

JP H09287217 A * 11/1997
JP 2006328715 A * 12/2006

*Primary Examiner* — Brian D Mattei
*Assistant Examiner* — Joseph J. Sadlon
(74) *Attorney, Agent, or Firm* — Hemisphere Law, PLLC

(57) ABSTRACT

A construction template is provided. The construction template includes a template body, a sound insulation material layer and an elastic damping device. The template body includes a base plate and a protective plate connected with the base plate in a thickness direction of the template body. The sound insulation material layer is disposed between the base plate and the protective plate. The elastic damping device is at least partially disposed between the base plate and the protective plate, and supports the protective plate, to define a gap between the protective plate and the sound insulation material layer. The construction template can be installed at a lower part of the floor which separates an upper floor from a lower floor of a building. The construction template uses the elastic damping device to isolate the protective plate from the sound insulation material layer.

16 Claims, 9 Drawing Sheets

(56) References Cited

U.S. PATENT DOCUMENTS 4,083,159 A * 4/1978 Hatch ..... B63G 8/34 52/309.3
4,321,776 A * 3/1982 Delight ..... E04H 9/021 52/274
4,514,714 A * 4/1985 Kanoi ..... H01F 27/33 181/208
4,702,046 A * 10/1987 Haugen ..... E04B 1/86 52/144
4,811,770 A * 3/1989 Rapp ..... E04C 2/06 52/332
4,811,927 A * 3/1989 Slonimsky ..... E04G 17/042 249/47
4,875,314 A * 10/1989 Boilen ..... E04H 9/14 52/236.7
4,971,850 A * 11/1990 Kuan-Hong ..... E04B 1/86 428/920
5,732,802 A * 3/1998 Tsukagoshi ..... E04H 9/0237 267/136
6,640,507 B1 * 11/2003 Leconte ..... E04B 1/86 52/145
6,782,672 B2 * 8/2004 Staats ..... B32B 3/02 52/272
7,188,820 B2 * 3/2007 Kobayashi ..... A47C 1/02 248/580
7,409,799 B2 * 8/2008 Tsai ..... E04H 9/023 52/167.6
7,549,507 B2 * 6/2009 Aida ..... F23J 13/02 52/293.3
7,631,727 B2 * 12/2009 Thomas ..... G10K 11/168 181/290
7,712,260 B2 * 5/2010 Vardaro ..... E04B 2/7422 52/36.6
7,743,563 B2 * 6/2010 Hilmy ..... E04H 9/021 52/167.2
7,895,796 B2 * 3/2011 Baldock ..... E04B 1/14 52/404.1
7,954,291 B2 * 6/2011 Cretti ..... E04B 5/36 52/332
8,079,189 B2 * 12/2011 Qu ..... E04B 1/161 52/251
8,156,696 B2 * 4/2012 Hubbard ..... E04H 9/023 52/167.6
8,276,337 B2 * 10/2012 Plini ..... F24D 5/00 52/302.1
8,375,676 B2 * 2/2013 Takakura ..... E04B 5/38 52/414
8,532,815 B1 * 9/2013 Ciuperca ..... B28B 11/24 702/81
8,789,651 B2 * 7/2014 Kawai ..... G10K 11/172 181/290
8,826,601 B2 * 9/2014 Gyory ..... E04B 1/3483 52/270
8,857,563 B1 * 10/2014 Chang ..... G10K 11/172 181/286
9,103,115 B2 * 8/2015 Wolf ..... E04B 1/8409
9,441,367 B2 * 9/2016 de Freitas Silvestre .. F16L 5/10
9,487,952 B2 * 11/2016 Nilsson ..... B32B 17/067
9,593,487 B2 * 3/2017 Harvey ..... E04C 2/044
9,752,330 B2 * 9/2017 Ohshima ..... E04F 15/02458
9,829,063 B2 * 11/2017 Cho ..... E04B 1/98
9,951,519 B2 * 4/2018 Neil ..... E04B 1/66
9,970,191 B2 * 5/2018 Hejazi ..... E04B 1/61
10,047,537 B2 * 8/2018 Douglas ..... E04H 9/0237
10,662,645 B2 * 5/2020 Kochiyama ..... F16F 15/022
10,709,917 B2 * 7/2020 An ..... E04B 1/94
10,982,434 B2 * 4/2021 Lee ..... E04B 1/90
11,255,407 B2 * 2/2022 Imanishi ..... F16F 15/035
11,460,086 B2 * 10/2022 Bank ..... F16F 15/002
11,668,091 B2 * 6/2023 Kragness ..... E04C 2/16 181/175
11,692,350 B2 * 7/2023 Barry ..... B32B 3/08 52/588.1
11,808,037 B2 * 11/2023 Oleske ..... E04B 1/86
11,862,136 B2 * 1/2024 Huang ..... G10K 11/168
12,104,431 B2 * 10/2024 Jiao ..... C08K 5/053
12,158,021 B2 * 12/2024 Chen ..... E04H 9/021
12,331,511 B2 * 6/2025 Headley ..... E04B 1/99
12,442,182 B2 * 10/2025 Thompson ..... B32B 13/02
12,529,223 B2 * 1/2026 Mckenna ..... E04B 1/86
2002/0162284 A1 * 11/2002 Karalic ..... E04C 2/386 52/272
2004/0020147 A1 * 2/2004 Martella ..... E04C 2/288 52/261
2008/0128202 A1 * 6/2008 Palumbo ..... B32B 3/12 428/116
2009/0049766 A1 * 2/2009 Kopish ..... E04B 2/82 52/167.1
2010/0089692 A1 * 4/2010 Dance ..... A47G 1/02 181/290
2010/0193662 A1 * 8/2010 Juen ..... B28B 19/003 52/309.1
2015/0211227 A1 * 7/2015 Collins ..... E04B 2/7448 52/745.1
2016/0122998 A1 * 5/2016 Parodi ..... E04B 5/38 52/167.1
2016/0145856 A1 * 5/2016 Bradford ..... E04B 1/6803 52/167.1
2021/0310235 A1 * 10/2021 Shanun ..... E04B 1/34326

* cited by examiner

CONSTRUCTION TEMPLATE

TECHNICAL FIELD

The disclosure relates to the field of construction technologies, particularly to a construction template, which is also referred to as a formwork.

BACKGROUND

Impact vibration sound transmission for a building is mainly implemented through the following steps: vibrating a floor of the building, propagating the vibration along a rigid connection surface of a building structure of the building, and exciting, by the vibration structure, air to emit sound to a receiver. An impact sound pressure level of such impact sound is related to an elastic modulus, a bulk density and a thickness of the floor, which is a common conclusion. Therefore, the existing building impact sound insulation technology is designed and developed around this conclusion. In order to improve the impact sound insulation performance of the floor, the following three ways are usually adopted.

A first way of the three ways is appropriately increasing the thickness of the floor.

Specifically, increasing the thickness of the floor will change a resonance frequency and a wavelength caused by the impact on the floor, and the thickness of the floor is the most effective to improve the impact sound pressure level of the floor. For example, an impact sound pressure level of a floor with a thickness of 14 centimeters (cm) is nearly 5 decibels (dB) lower than that of a floor with a thickness of 11 cm. The impact sound pressure level of the floor with the thickness of 11 cm is about 84 dB, while a standard limit of a residential impact sound level of a national standard of China is less than 65 dB, a standard limit of a residential impact sound level of a national standard of Japan is less than 51 dB, a standard limit of a residential impact sound level of a national standard of Britain is less than 38 dB, and a standard limit of a residential impact sound level of a national standard of Germany is less than 39 dB. If the sound insulation effect is achieved by increasing the thickness of the floor, the thickness of the floor will be more than 23 cm when it reaches the national standard of China, and the thickness of the floor with comfortable impact sound insulation performance should be at least 30 cm. A conclusion reported from Korean demonstrated even if the impact sound pressure level reaches the national standard of British of 38 dB, obvious impact sound can still be heard, therefore, it is unrealistic to simply increase the thickness of the floor for improving the impact sound insulation performance of the floor.

A second way of the three ways is floating floor.

Specifically, a sound insulation principle of the floating floor is to use a damping material to block the transmission of vibration in the floor, which is achieved through the following steps: putting an elastic sound insulation layer on a load-bearing reinforced concrete floor, laying a poured concrete mortar layer on the elastic sound insulation layer, and laying a floor on the poured concrete mortar layer. The elastic sound insulation layer between the floor and the load-bearing reinforced concrete floor constitutes a vibration isolation and damping system. The greater the quality of the load-bearing reinforced concrete floor, the better the elasticity of the elastic sound insulation layer and the better the sound insulation. However, the floating floor technology has its limitations at present, that is, if the damping of a middle floor, i.e., elastic sound insulation layer, is increased to an ideal sound insulation level, a corresponding building structure and a corresponding load-bearing system will not be ideal; while the damping performance of the damping material will be sacrificed, when considering the ideal load-bearing system, therefore, the requirements for both the damping and the load-bearing system can only be taken into account to a certain extent, to reach an equilibrium point. As such, the ideal sound insulation effect cannot be achieved.

A third way of the three ways is sound insulation through floor ceiling.

Specifically, a high damping and sound insulation ceiling is set under a floor, and is spaced from the floor at a certain distance. The high damping and sound insulation ceiling is used to attenuate the resonance of the floor after being impacted, so as to achieve sound insulation effect. However, the sound insulation through floor ceiling has a shortage of sacrificing a height of the floor. Although this sound insulation method can be combined with the aforementioned two sound insulation methods to further improve the sound insulation effect, there are still shortcomings even if they are combined owing to the shortcomings of the aforementioned two sound insulation methods.

Therefore, it is urgent to put forward a novel, more reasonable and high-performance building technology for insulation of impact sound of a floor.

SUMMARY

In view of the above, an objective of the disclosure is to provide a construction template, which can realize more reasonable and high-performance insulation of impact sound of a floor.

In order to achieve the above objective, the disclosure provides a construction template, which includes a template body, a sound insulation material layer, and an elastic damping device;

the template body includes a base plate and a protective plate connected with the base plate, which are arranged in a thickness direction of the template body;

the sound insulation material layer is disposed between the base plate and the protective plate; and the elastic damping device is at least partially disposed between the base plate and the protective plate, and the elastic damping device is configured to support the protective plate and make a gap be formed between the protective plate and the sound insulation material layer.

In an embodiment, at least one of a first elastic damping material layer for isolating a building wall or a second elastic damping material layer for isolating another construction is attached to a periphery of each of the base plate and the protective plate.

In an embodiment, a part of the sound insulation material layer at peripheral side of the sound insulation material layer is protruded from the template body; and the part of the sound insulation material layer is covered by the first elastic damping material layer or the second elastic damping material layer.

In an embodiment, a bottom surface of the base plate facing away from the protective plate is defined with a shear wall lap groove at an edge of the bottom surface; and a third elastic damping material layer is disposed in the shear wall lap groove.

In an embodiment, a top surface of the base plate facing towards the protective plate is provided with a fixing rod, and the fixing rod passes through the top surface; and a part of a rod segment of the fixing rod extends beyond the protective plate.

In an embodiment, the top surface of the base plate is provide with a boss; a part of the fixing rod is disposed in the boss; the elastic damping device includes a first elastic damper; and the first elastic damper is fixed on the boss, and the fixing rod passes through the first elastic damper.

In an embodiment, a part of the first elastic damper is protruded from the protective plate, and the part of the first elastic damper is in sealing contact with the protective plate and the fixing rod.

In an embodiment, the base plate is provided with a connecting seat part; the elastic damping device further includes a second elastic damper; the second elastic damper is disposed on the connecting seat part and is configured to support the protective plate together with the first elastic damper; the protective plate is provided with a first threaded fastener thereon; and a threaded portion of the first threaded fastener is screwed into the connecting seat part, to fasten the protective plate with the connecting seat part.

In an embodiment, a head portion of the first threaded fastener is covered with a fourth elastic damping material layer.

In an embodiment, the construction template further includes a connecting component; a connecting groove part is disposed on the base plate; a connecting plate is disposed in the connecting groove part; and the connecting component is configured to connect two the connecting plates on two the template bodies of two the construction templates to connect the two template bodies together.

In an embodiment, the connecting component includes a first slider, a second slider, and a slider connector; the first slider is slidably disposed in the connecting groove part and located at a side of the connecting plate; the second slider is slidably disposed in the connecting groove part and located at another side of the connecting plate; two limiting cavities are defined between the first slider and the second slider, to limit positions of parts of the two connecting plates, respectively; and the slider connector is configured to connect the first slider and the second slider together, to thereby make the first slider and the second slider clamp and fix the connecting plate.

In an embodiment, the slider connector includes: a baffle, a second threaded fastener, and a first lock nut; the first slider is defined with a threaded hole, and a thread rod of the second threaded fastener is screwed into the threaded hole; the baffle is disposed at a side of the second slider facing away from the first slider, the baffle is movably sleeved onto the second threaded fastener, and the baffle is in contact with the second slider and abuts against the second slider; and the first lock nut is threadedly sleeved onto the second threaded fastener, the first lock nut is configured to fasten the first slider and the second slider together by driving the baffle to move, to thereby make the first slider and the second slider clamp and fix the connecting plate.

In an embodiment, the construction template includes a component connector; and the component connector is configured to connect two the connecting components together.

In an embodiment, the component connector further includes a third threaded fastener and two second lock nuts; a surface of the first slider facing away from the second slider is provided with a fastener connecting part; the fastener connecting part is defined with a connecting cavity; the fastener connecting part is defined with a connecting hole, and the connecting hole is communicated with the connecting cavity along a direction from the first slider to the second slider; and two ends of the third threaded fastener are disposed to respectively extend into corresponding two connecting cavity of the two connecting components through corresponding two connecting holes of the two connecting components; and the second lock nuts are threadedly sleeved onto the two ends of the third threaded fastener, respectively, the second lock nuts are located in the two connecting cavities, respectively, and the second lock nuts are respectively in contact with corresponding two fastener connecting parts of the two connecting components, and the two second lock nuts are disposed to abut against the two fastener connecting parts.

In an embodiment, the first slider is covered with a fifth elastic damping material layer, and the fifth elastic damping material layer is in contact with the connecting groove part and the connecting plate; and the second slider is covered with a sixth elastic damping material layer, and sixth elastic damping material layer is in contact with the connecting groove part.

In an embodiment, the first slider is provided with a protruding column thereon; the protruding column is defined with the threaded hole; the second slider is internally defined with a through cavity, two side positions in the through cavity relative to the protruding column are respectively provided with limit ribs, and the limit ribs are disposed along an axial direction of the protruding column; each of the limit ribs has an inclined plane and a plane, and the plane is connected with the inclined plane and is parallel to a central axis of the protruding column; a guide space is defined between the inclined planes of the limit ribs, and the guide space gradually narrows from the first slider to the second slider; and the two limiting cavities are defined between the planes of the limit ribs and the protruding column.

In an embodiment, the connecting plate is elastically deformable.

In an embodiment, the construction template includes a vibration isolation tie rod; an end of the vibration isolation tie rod passes through the protective plate of the template body of the construction template and is connected with the base plate of the template body; and another end of the vibration isolation tie rod passes through a protective plate of a template body of another construction template and is connected with a base plate of the another template body.

As can be seen from the above technical solutions, the construction template designed in the disclosure can be installed at a lower part of a floor for separating a upper floor from a lower floor, which uses the elastic damping device to isolate the protective plate from the sound insulation material layer, and forms an insulation system under the sound isolation function of the sound insulation material layer, the insulation system can isolate propagation of a vibration wave and a sound wave from the floor, and attenuates a vibration wave generated by the impact received by the upper floor to the greatest extent through the elastic damping device, thereby reducing vibration excitation of the vibration wave to a unit space of the lower floor and achieving better sound insulation and vibration reduction effect.

BRIEF DESCRIPTION OF DRAWINGS

In order to explain technical solutions of embodiments of the disclosure or technical solutions in the related art more clearly, drawings needed to be used in the description of the embodiments or the related art will be briefly introduced hereinafter. Apparently, the drawings in the following description are merely some embodiments of the disclosure.

For ordinary people in the art, other drawings can be obtained according to these drawings without creative labor.

REFERENCE NUMERALS

Figure 1:
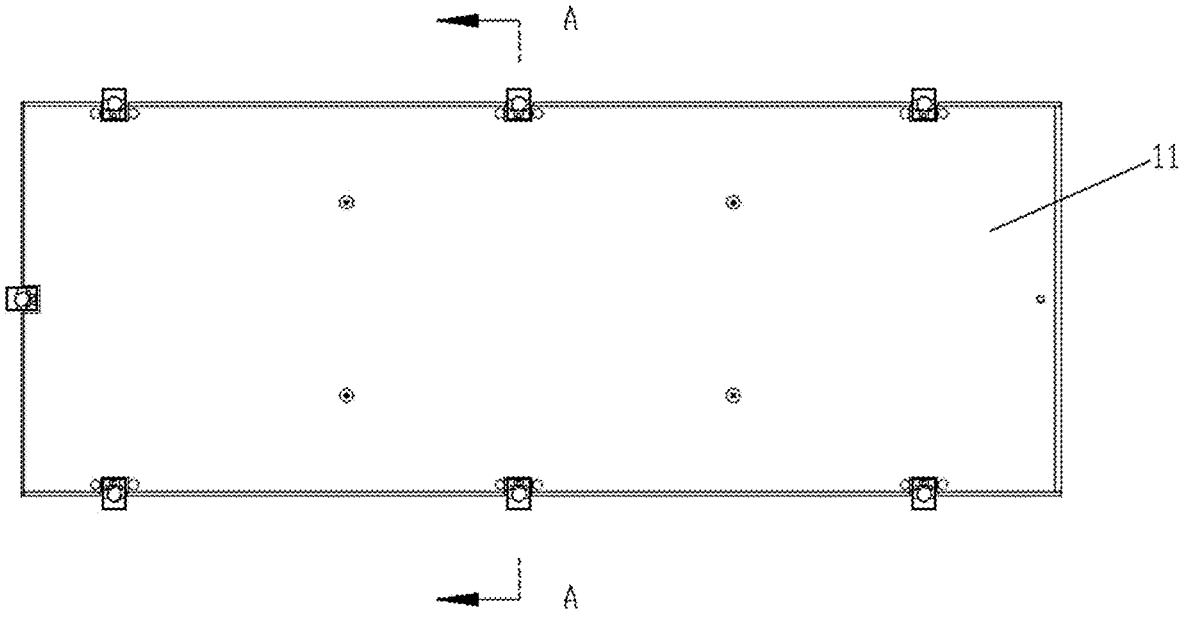
FIG. 1 illustrates a schematic top view of a construction template as a special template for floor connection according to an embodiment of the disclosure.

1—template body; 11—protective plate; 12—base plate; 121—shear wall lap groove; 122—boss; 123—concave hole; 124—connecting seat part; 125—groove; 2—sound insulation material layer; 3—elastic damping device; 31—first elastic damper; 311—upper convex portion; 312—lower convex portion; 32—second elastic damper; 41—first elastic damping material layer; 42—second elastic damping material layer; 43—third elastic damping material layer; 44—fourth elastic damping material layer; 45—fifth elastic damping material layer; 46—sixth elastic damping material layer; 5—fixing rod; 61—first threaded fastener; 62—connecting groove part; 621—wing plate; 622—connecting plate; 623—first plate part; 624—second plate part; 7—connecting component; 71—second threaded fastener; 72—first lock nut; 73—baffle; 74—second slider; 741—limit rib; 742—plane; 743—inclined plane; 744—limiting cavity; 745—limiting cavity; 75—first slider; 751—protruding column; 752—threaded hole; 76—fastener connecting part; 77—third threaded fastener; 78—second lock nut; 79—vibration isolation tie rod; 8—T-shaped vibration isolation sleeve; 91—fixing angle plate; 92—strengthened connection steel bar; and 93—wall positioning bolt.

DETAILED DESCRIPTION OF EMBODIMENTS

The technical solutions of the embodiment of the disclosure will be described clearly and completely with the accompanying drawings. Apparently, the described embodiments are parts of embodiments of the disclosure, but not the whole embodiments. Based on the described embodiments in the disclosure, all other embodiments obtained by the skilled in the art without creative labor belong to the scope of protection of the embodiments of the disclosure.

In the description of the embodiments of the disclosure, it should be noted that the azimuth or positional relationship indicated by the terms "center", "upper", "lower", "left", "right", "vertical", "horizontal", "inside" and "outside" are based on the azimuth or positional relationship shown in the accompanying drawings, and are only for the convenience of describing the embodiments of the disclosure and simplifying the description, but not for indicating or implying that the referred device or element must have a specific orientation, be constructed and operated in a specific orientation, therefore, the terms cannot be understood as limiting the embodiments of the disclosure. In addition, the terms "first", "second" and "third" are only used for descriptive purposes and cannot be understood as indicating or implying relative importance.

In the description of the embodiments of the disclosure, it should be noted that, unless otherwise specified and limited, the terms "installation", "connected" and "connection" should be broadly understood, for example, they may be fixed connection, replaceable connection, or integrated connection; or may be mechanical connection, or electrical connection; or may be direct connection, indirect connection through an intermediary, or internal communication between two elements. For the skilled in the art, the specific meanings of the above terms in the embodiments of the disclosure can be understood in specific situations.

The embodiments of the disclosure provide construction templates.

Figure 2:
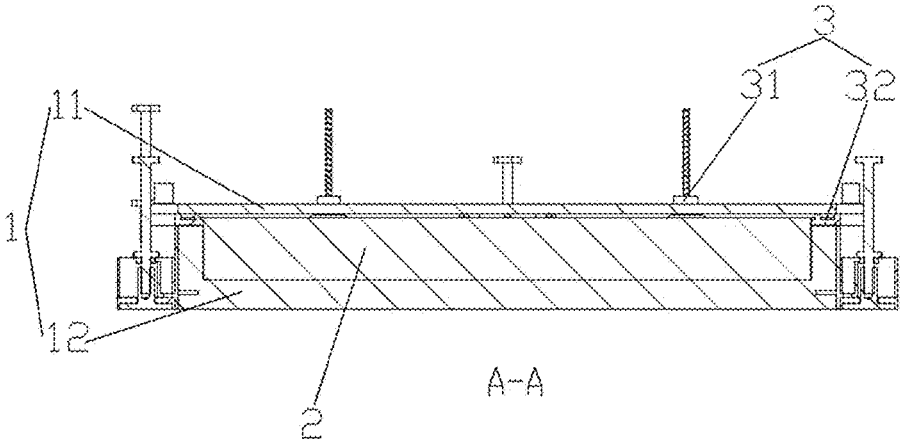
FIG. 2 illustrates a schematic sectional view taken along a line A-A of the construction template of FIG. 1.

As illustrated in FIG. 1 and FIG. 2, an embodiment of the disclosure provides a construction template, which includes: a template body 1, a sound insulation material layer 2, and an elastic damping device 3.

The template body 1 includes a base plate 12 and a protective plate 11 connected to the base plate 12 in a thickness direction of the template body 1. The protective plate 11 can be made of glass fiber reinforced poured concrete, basalt fiber reinforced poured concrete, plant fiber reinforced poured concrete, or calcium carbonate plate. A side of the protective plate 11 facing away from the base plate 12 is a concrete pouring surface. A shape of the base plate 12 is matched with that of the protective plate 11, and a manufacturing material of the base plate 12 is the same as that of the protective plate 11. Alternatively, an outer surface of the base plate 12 can be processed to have a required pattern or color in the factory, so that the outer surface can be used as an exposed floor surface, and decorating can also be performed on the outer surface.

The sound insulation material layer 2 is disposed between the base plate 12 and the protective plate 11. The elastic damping device 3 is at least partially disposed between the base plate 12 and the protective plate 11, and the elastic damping device 3 is disposed to support the protective plate 11, and a gap is formed between the protective plate 11 and the sound insulation material layer 2. The elastic damping device 3 provides supporting for the protective plate 11 to form a certain gap, as such, when concrete is poured onto the protective plate 11, the elastic damping device 3 will generate a certain amount of compression due to gravity, and then release a certain amount of compression after the concrete dries and shrinks, so that the elastic damping device 3 is in a reasonable compression state.

In an embodiment, the elastic damping device 3 is made of higher damping material.

By using the elastic damping device 3, a transmission process of a vibration wave generated by impact is taken as a control object, and the subjected vibration energy is converted into heat energy for loss, so that when the vibration wave excites the air in a space of a lower floor to emit air sound, the vibration wave has been greatly attenuated. In an embodiment, the elastic damping device 3 is attached to a lower surface of the protective plate 11 with a certain pressure, but a compression amplitude of the elastic damping device 3 is preferably controlled within 15% to maintain permanent elasticity and good extensibility. The usage amount of the elastic damping device 3 of the disclosure is smaller, and non-toxic and flame-retardant material is adopted for the elastic damping device 3.

In the disclosure, in addition to attenuating the impact vibration by using the elastic damping device 3, the sound insulation material layer 2 is also configured to filter out the residual air sound after attenuation. In an embodiment, a material of the sound insulation material layer 2 is mainly incombustible A-grade material such as rock wool, sound-absorbing cotton, and perlite board, which is nontoxic and odorless, and has a lower heat transfer coefficient. Therefore, the sound insulation material layer 2 can meet the requirements of thermal insulation and energy saving for a concrete-poured floor. In addition, the sound insulation material layer 2 is light in weight and thin in thickness, and can control and reduce a total thickness of a building floor.

In the construction template of the disclosure, the elastic damping device 3 and the sound insulation material layer 2 are equivalent to being installed in the building floor, therefore, the construction template is isolated from external factors such as ultraviolet rays. As such, as long as waterproof and moisture-proof measures are taken, aging resistance of the construction template is also guaranteed, so the sound insulation performance durability of the elastic damping device and sound insulation material in the disclosure can be guaranteed.

In addition, in order to improve the construction efficiency and reduce the construction cost, the construction template of the disclosure can be an embedded construction template. The base plate 12 and the protective plate 11 can be manufactured in the factory according to the corresponding size standards, and the base plate 12 and the protective plate 11 are designed to be assembled together. In an embodiment, an outer surface of the base plate 12 facing away from the protective plate 11 is designed with various patterns and colors, therefore, it is not required to perform redecorating.

As can be seen from the above technical solutions, the construction template designed in the disclosure can be installed at a lower part of a floor for separating an upper floor from the a lower floor. The construction template forms a non-dismountable formwork integrated with post-poured concrete. The construction template uses the elastic damping device 3 to isolate the protective plate 11 from the sound insulation material layer 2, and forms an insulation system under the sound isolation function of the sound insulation material layer 2, the insulation system can isolate propagation of a vibration wave and a sound wave from the floor, and attenuates a vibration wave generated by the impact received by the upper floor to the greatest extent through the elastic damping device 3, thereby reducing vibration excitation of the vibration wave to a unit space of the lower floor and achieving better sound insulation and vibration reduction effect.

In summary, the design of the disclosure focuses on the combined application of the elastic damping device 3 and the sound insulation material layer 2, which improves the mode of the construction template, and can make the elastic damping device 3 and the sound insulation material layer 2 become an integral part of a permanent construction template in a construction process. As such, the damping for vibration reduction is improved, the construction cost is reduced, and a damping system is formed by using the elastic damping device 3 to completely isolate a vertical impact vibration wave generated by the upper floor from the space of the lower floor.

The above is a first implementation of the construction template provided by the embodiments of the disclosure, and the following is a second implementation of the construction template provided by the embodiments of the disclosure, which is illustrated in FIG. 1 through FIG. 18.

Figure 3:
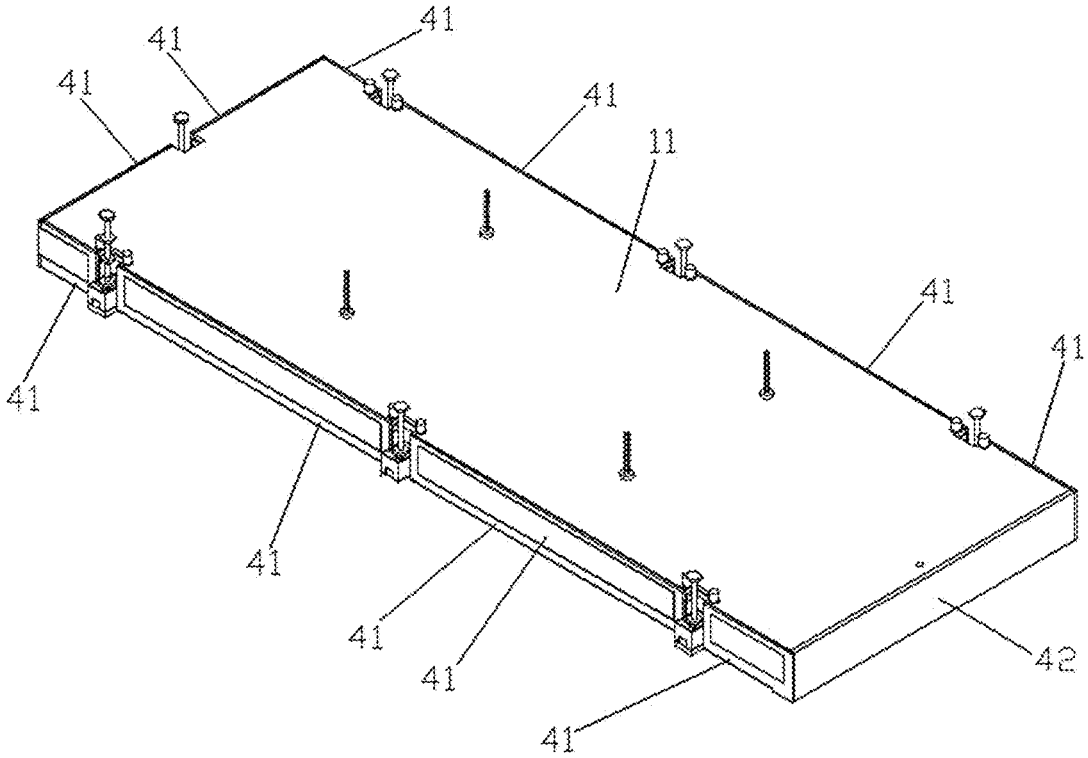
FIG. 3 illustrates a schematic perspective view of a construction template as a special template for floor connection according to an embodiment of the disclosure.

Based on the technical solution of the first implementation, as illustrated in FIG. 3, in order to prevent the impact sound wave generated by the upper floor from transmitting downward from the gap, joints between construction templates must be tightly sealed with sound insulation materials. A first elastic damping material layer 41 for isolating a building wall and/or a second elastic damping material layer 42 for isolating another construction template is/are attached to a periphery of each of the base plate 12 and the protective plate 11. When the construction templates in the disclosure are connected with each other, the first elastic damping material layers 41 between the construction templates can be in sealed contact by using a force generated during the connection, so that the construction templates can be isolated from each other. Similarly, the construction templates are isolated from the building wall by using the same method, that is, the construction templates are isolated from the building wall by using the second elastic damping material layer 42. Therefore, a complete closed isolation system that can isolate the floor vibration wave and limit sound wave propagation is formed. Moreover, the arrangement of the first elastic damping material layer 41 and the second elastic damping material layer 42 also seals gaps around the protective plate 11, the base plate 12 and the sound insulation material layer 2, so as to prevent concrete from infiltrating into the sound insulation material layer 2.

Figure 4:
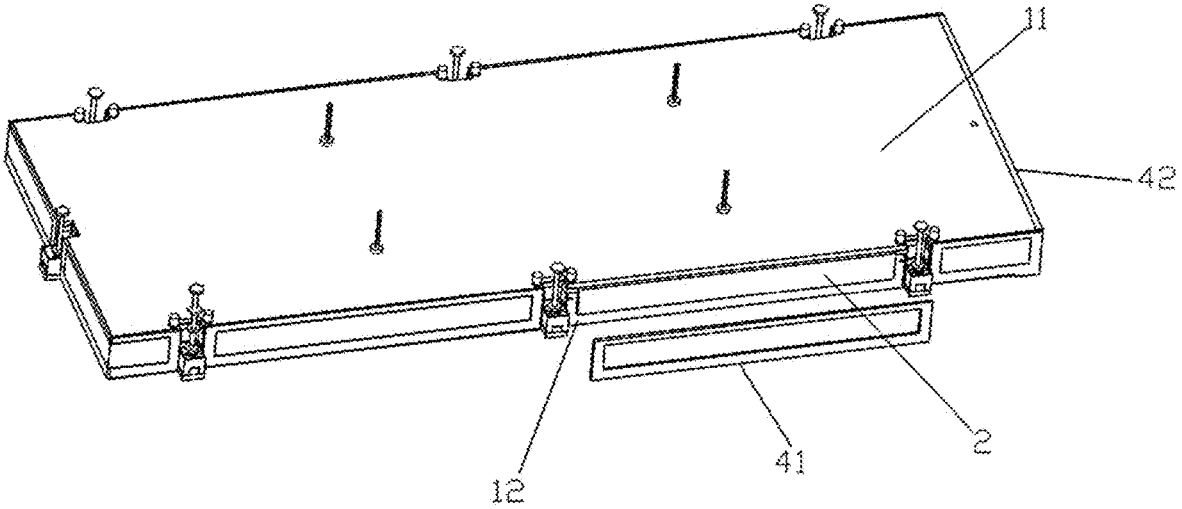
FIG. 4 illustrates a schematic partial exploded view of a construction template as a special template for floor connection according to an embodiment of the disclosure.

As illustrated in FIG. 4, in an embodiment, in order to facilitate the sealing of the gap on the periphery of the template body 1, the periphery of the sound insulation material layer 2 is designed to partially protrude from the template body 1. That is to say, the periphery of the sound insulation material layer 2 is designed to protrude to a certain extent, and the part of the periphery of the portion protruding from the template body 1 is covered by the first elastic damping material layer 41 or the second elastic damping material layer 42, and adhesive is applied for bonding the template body 1 and the first elastic damping material layer 41, or bonding the template body and the second elastic damping material layer 42. For example, in a situation that a side of the sound insulation material layer 2 corresponding to isolation of the building wall is not protruded from the template body 1, and other sides of the sound insulation material layer 2 are protruded from the template body 1, the corresponding protruding parts are covered with the first elastic damping material layers 41 to achieve gap sealing therein, while the second elastic damping material layers 42 on the side not protruded from the template body 1 corresponding to isolation of the building wall can cover the whole side corresponding to isolation of the building wall, to achieve gap sealing therein. In the design of the construction template, the first elastic damping material layer 41 and the second elastic damping material layer 42 are connected and bonded to each other, so as to seal the entire peripheral side of the template body 1.

In the disclosure, the elastic damping device 3 is used to restrain the vibration wave generated by the impact of the upper floor from exciting air in a space of the lower floor to generate noise. In addition, the elastic damping device 3 is combined with the first elastic damping material layer 41 and the second elastic damping material layer 42 to isolate the construction template from the upper floor and the building wall, thereby minimizing the impact noise generated by the upper floor.

Figure 5:
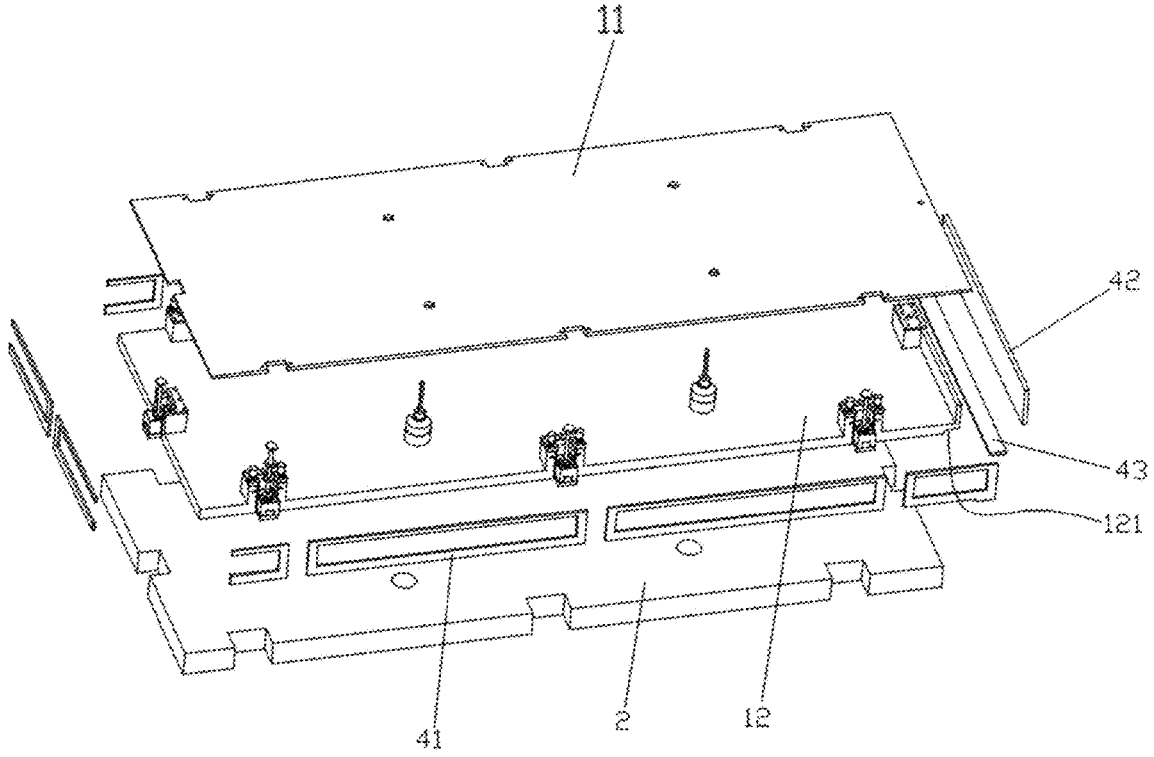
FIG. 5 illustrates a schematic overall exploded view of a construction template as a special template for floor connection according to an embodiment of the disclosure.

As illustrated in FIG. 5, in an embodiment, in order to make the construction template in the disclosure accurately lap with the building wall, a shear wall lap groove 121 can be defined at a lap position of the base plate 12 with the building wall by processing the base plate 12. A third elastic damping material layer 43 can be pasted in the shear wall lap groove 121.

Figure 6:
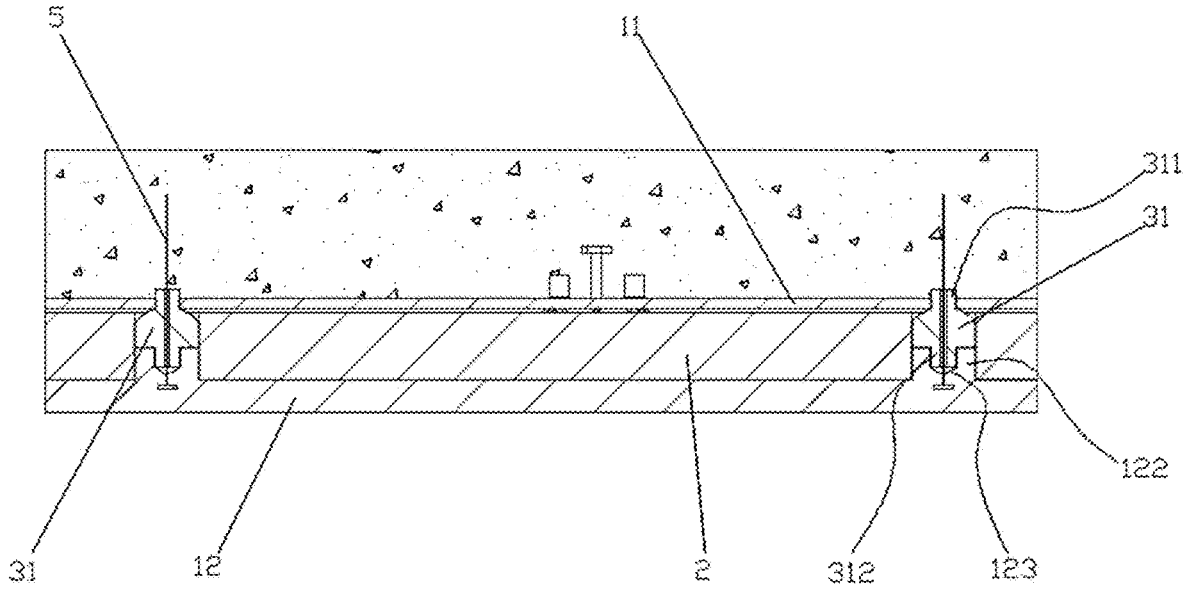
FIG. 6 illustrates a partial sectional view of a construction template as a special template for floor connection according to an embodiment of the disclosure, in which concrete is poured to the construction template.

As illustrated in FIG. 6, in an embodiment, a top surface of the base plate 12 is provided with a fixing rod 5 passing through the top surface, and a part of a rod segment of the fixing rod 5 is disposed to penetrate out of the protective plate 11. Specifically, the fixing rod 5 is at least two in number, and a distribution manner of the at least two fixing rods 5 can be determined according to actual requirements, and there is no restriction herein.

Correspondingly, at least two holes for the at least two fixing rods 5 to pass therethrough in one-to-one correspondence are defined in the protective plate 11. The fixing rods 5 can be steel bars, or threaded bars, which is not limited herein. The part of each fixing rod 5 penetrating out of the protective plate 11 is combined with a concrete-poured floor, so that the construction template and the concrete-poured floor can be better integrated.

As illustrated in FIG. 6, in an embodiment, at least two bosses 122 are provided on the top surface of the base plate 12, and the at least two fixing rods 5 partially pass through the at least two bosses 122 in one-to-one correspondence.

As far as the design of the elastic damping device 3 is concerned, in an embodiment, the elastic damping device 3 includes at least two first elastic dampers 31 corresponding to the at least two fixing rods 5 one by one. The at least two first elastic dampers 31 are fixed on the at least two bosses 122 one by one and is configured to allow the at least two fixing rods 5 to pass therethrough. Through the combination of the at least two first elastic dampers 31 with the at least two fixing rods 5, it is more convenient for installation and arrangement of the at least two first elastic dampers 31, and the at least two first elastic dampers 31 can deform when compressed to better block holes in the protective plate 11. In addition, in order to further facilitate the arrangement of the at least two first elastic dampers 31, a bottom of each first elastic damper 31 is provided with a lower convex portion 312; and each boss 122 is defined with a concave hole 123 for accommodating the lower convex portion 312, so that the first elastic damper 31 and the boss 122 can be more firmly combined.

As illustrated in FIG. 6, in an embodiment, in order to better improve the sealing performance of each first elastic damper 31 to a corresponding hole in the protective plate 11 through which a corresponding fixing rod 5 passes, the first elastic damper 31 is designed to partially penetrate out of the protective plate 11 through the corresponding hole; and the penetrated part is in sealing contact with the protective plate 11 and the corresponding fixing rod 5. That is to say, the first elastic damper 31 is designed with an upper convex portion 311 that passes through the corresponding hole and is in sealing contact with the corresponding fixing rod 5. This design can better prevent concrete and moisture from infiltrating into the sound insulation material layer 2 and play a better sealing role.

When the floor is impacted, a generated vibration wave is transmitted downward through the floor and through the fixing rods 5, and the vibration wave transmitted through the floor is absorbed and attenuated by the first elastic dampers 31.

Figure 7:
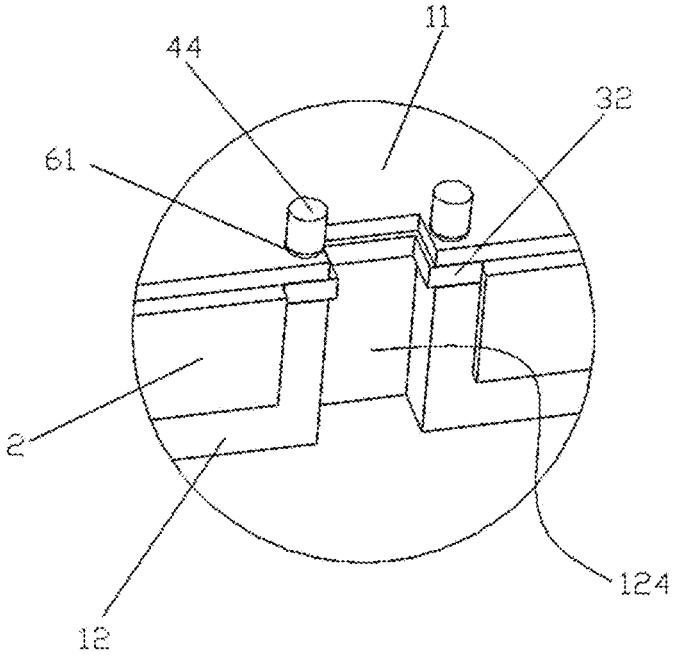
FIG. 7 illustrates a schematic partial structural view showing a connection and cooperation manner between a base plate and a protective plate of a construction template as a special template for floor connection according to an embodiment of the disclosure.
Figure 8:
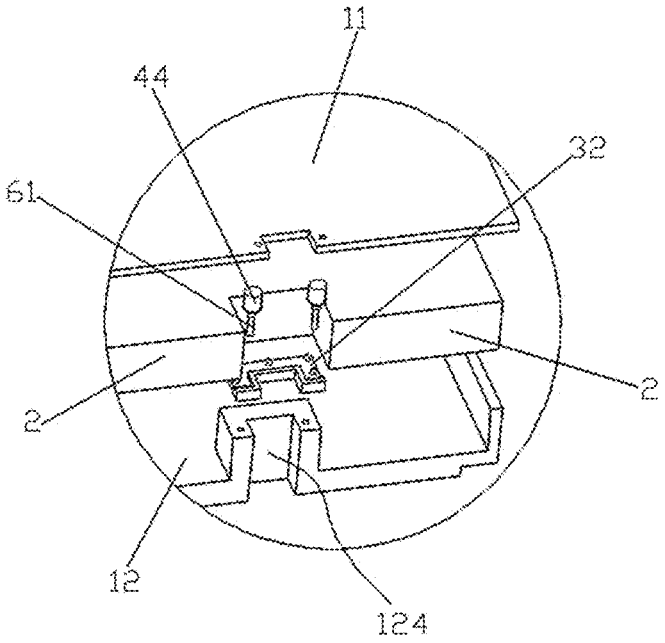
FIG. 8 illustrates a schematic exploded view showing a connection and cooperation manner between a base plate and a protective plate of a construction template as a special template for floor connection according to an embodiment of the disclosure.

As illustrated in FIG. 7 and FIG. 8, in an embodiment, in order to realize the connection between the base plate 12 and the protective plate 11, the base plate 12 is integrally provided with at least two connecting seat parts 124, and the elastic damping device 3 further includes at least two second elastic dampers 32. The at least two second elastic dampers 32 are installed on the at least two connecting seat parts 124 in one-to-one correspondence, and are disposed to support the protective plate 11 together with the at least two first elastic dampers 31. A structure of each second elastic damper 32 can be plate-shaped. When the second elastic damper 32 is installed on the connecting seat part 124, and a supporting height of the second elastic damper 32 for the protective plate 11 is the same as that of each first elastic damper 31 for the protective plate 11, or a height of the second elastic damper 32 between the protective plate 11 and the sound insulation material layer 2 is the same as that of the first elastic damper 31 between the protective plate 11 and the sound insulation material layer 2. The first elastic dampers 31 and the second elastic dampers 32 jointly support the protective plate 11 to keep a certain gap with the sound insulation material layer 2 and together provide damping function. The reason why the protective plate 11 keeps the certain gap with the sound insulation material layer 2 is that the elasticity and damping effect of the sound insulation material layer 2 are much lower than that of the elastic damping device 3. Under the gravity of the poured concrete, the first elastic dampers 31 and the second elastic dampers 32 will contract to a certain extent, so that the protective plate 11 will stick to the sound insulation material layer 2. When the poured concrete dries and contracts, part of the shrinkage will be released, so that the first elastic dampers 31 and the second elastic dampers 32 will play a role prior to the sound insulation material layer 2. In addition, the second elastic dampers 32 also provide a sealing function to prevent slurry from flowing into the sound insulation material layer 2 in the construction template when pouring concrete, and block the transmission channel effect of vibration and noise owing to the flowing of the slurry.

The protective plate 11 is provided with first threaded fasteners 61, which can be screws, or bolts, which is not limited herein. A threaded portion of each first threaded fastener 61 is threadedly engaged with a corresponding connecting seat part 124 to fasten the protective plate 11 and the connecting seat part 124 together.

As illustrated in FIG. 7 and FIG. 8, in an embodiment, a head portion of the first threaded fastener 61 is covered with a fourth elastic damping material layer 44. By coating the head portion of the first threaded fastener 61 with the fourth elastic damping material layer 44, the vibration wave can be effectively prevented from being transmitted through there. In addition, the fourth elastic damping material layer 44 can also improve the sealing performance of the connection between the first threaded fastener 61 and the protective plate 11.

Figure 9:
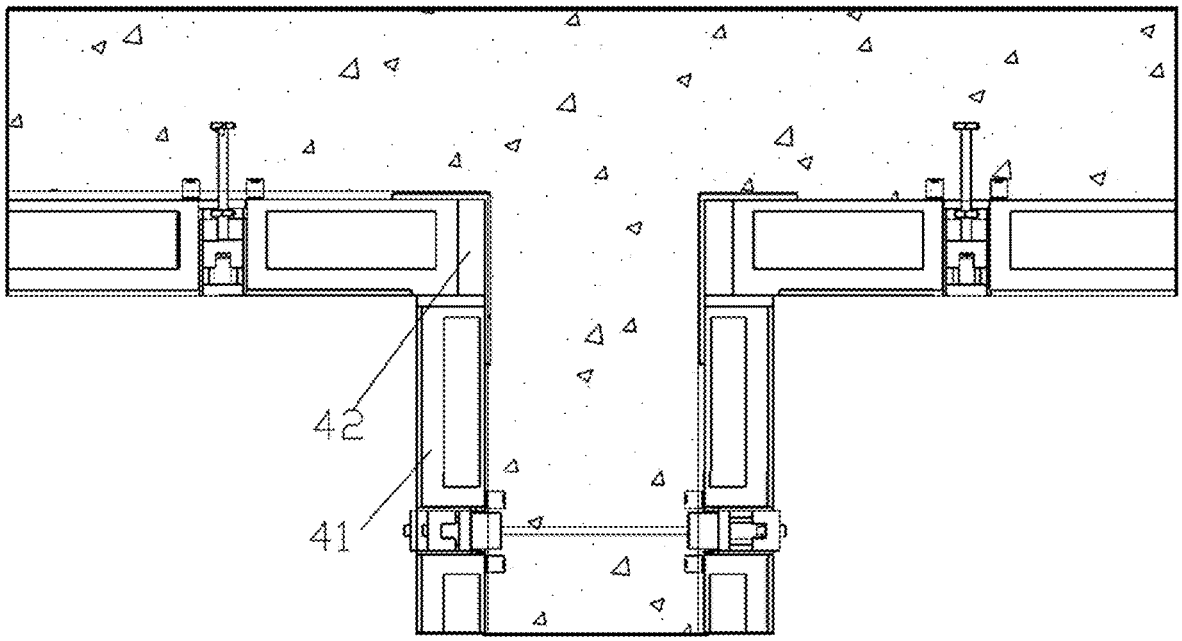
FIG. 9 illustrates a schematic first partial structural view of construction templates, which are combined with concrete poured to the construction templates, according to an embodiment of the disclosure.

FIG. 9 illustrates a schematic view of an overlapping application of the construction templates in the disclosure. Upper two construction templates are used as special templates for floor connection, while lower two construction templates are used as special templates for wall connection. When an upper floor is impacted, an upper surface of the upper floor vibrates and excites air to emit sound to spread to a surrounding space. This sound mainly affects a corresponding closed space, but has little effect on other floors. When the impact occurs, in addition to exciting the upper air, the vibration wave is transmitted to a lower surface of the floor through the floor at the same time, and the air in a space of a lower floor is excited by the vibration wave to generate noise and spread the noise. This noise is a main noise source that affects the lower floor. The principle of impact noise generation and propagation of partition walls and shear walls is similar. In view of this, the disclosure uses elastic damping materials to control and isolate the vibration waves of concrete floors and building walls. That is to say, non-detachable construction template with the elastic damping device 3 and auxiliary damping materials (first elastic damping material layer 41, second elastic damping material layer 42, and the like) is used to isolate and attenuate the vibration of post-poured concrete floors or building walls. Different from the existing floating floor technology, this design in the disclosure uses higher damping materials, which can greatly attenuate the transmission amplitude of vibration and reduce the noise in the lower space or the next space.

Figure 10:
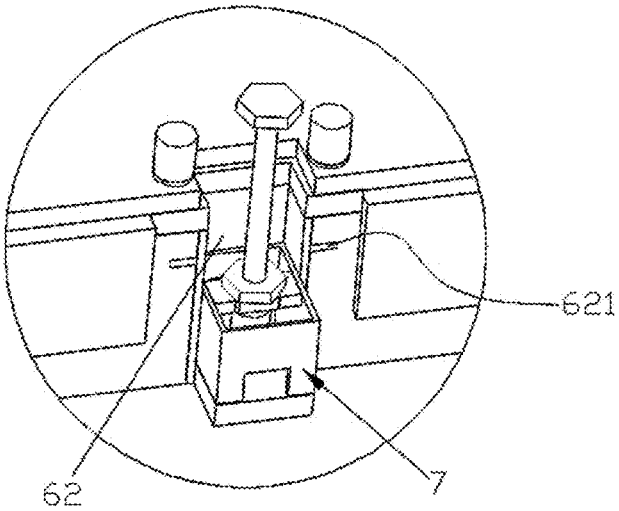
FIG. 10 illustrates a schematic partial structural view of a construction template as a special template for floor connection, to which a connection component is connected, according to an embodiment of the disclosure.
Figure 12:
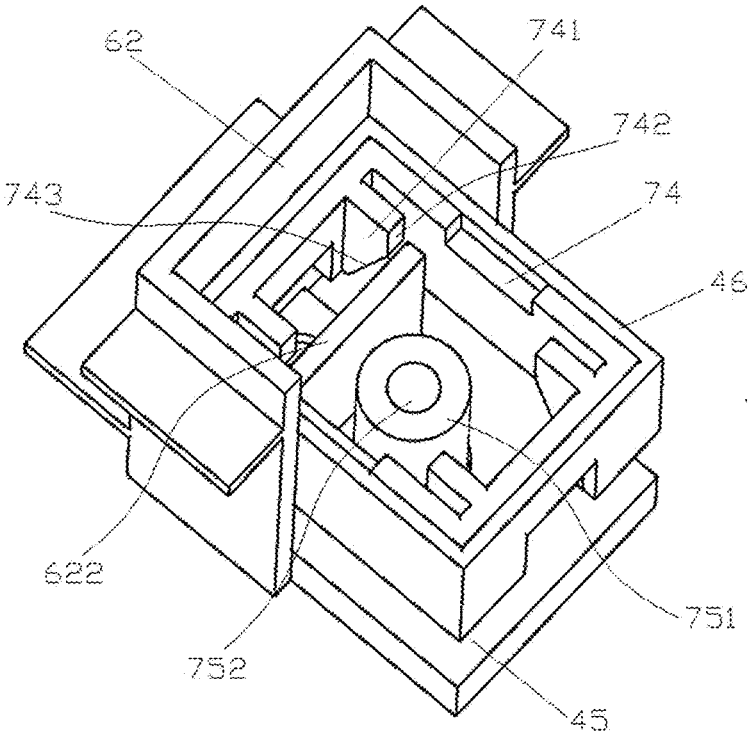
FIG. 12 illustrates a schematic perspective view of a connecting component according to an embodiment of the disclosure, in which a first slider and a second slider of the connecting component are cooperative with a connecting groove part.

As illustrated in FIG. 10 and FIG. 12, in an embodiment, the disclosure further provides a connecting component 7.

A connecting groove part 62 is partially embedded in the base plate 12, and a connecting plate 622 is disposed on the connecting groove part 62. The connecting component 7 is used to connect two connecting plates 622 on two template bodies 1 of two construction templates with a same structure described above, so as to connect the two template bodies 1 together. As far as the design of the connecting groove part 62 is concerned, the connecting groove part 62 is made of a metal material, and the connecting groove part 62 can be partially embedded in the connecting seat part 124 of the aforementioned design, and has a U-shaped groove structure. Wing plates 621 are disposed outside the connecting groove part 62, and the wing plates 621 are embedded in the base plate 12 to play a fixing role. The wing plates 621 can bear a lateral tension and a longitudinal tension generated when the construction templates are overlapped. The distribution position and number of the wings 621 can be set as required. In addition, the specific number of the connecting component 7 can be determined according to the actual continuous needs, which is not limited herein.

Figure 11:
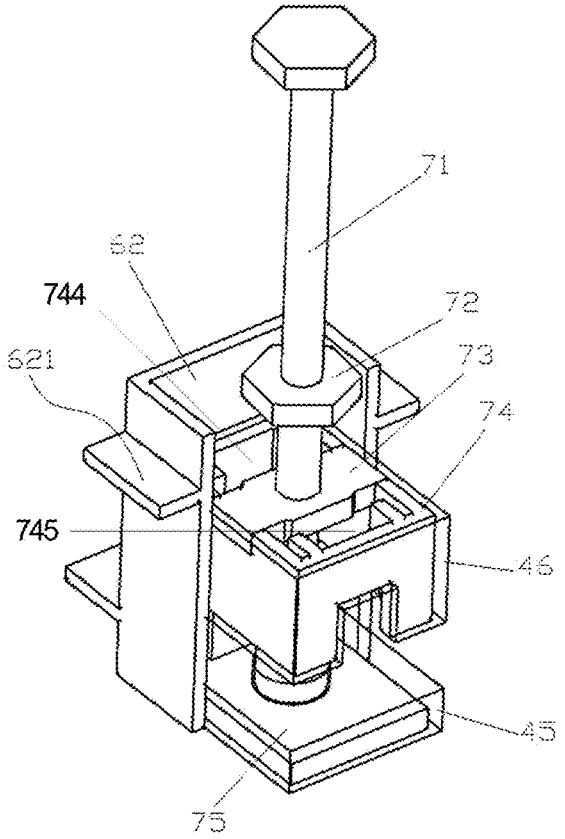
FIG. 11 illustrates a schematic perspective view of a connecting component of a construction template according to an embodiment of the disclosure, in which the connecting component is cooperative with a connecting groove part.

Further, taking the way that construction templates are spliced and connected with each other in their own lateral directions as an example, that is, the connection between special templates for wall connection, as shown in FIG. 11 and FIG. 12, the connecting component 7 can be designed to include a first slider 75, a second slider 74, and a slider connector.

The first slider 75 is slidably disposed in the connecting groove part 62 and located at A side of the connecting plate 622, and the second slider 74 is slidably disposed in the connecting groove part 62 and located at an opposite side of the connecting plate 622. Two limiting cavities 744 and 745 are defined between the first slider 75 and the second slider 74 to limit the two connecting plate 622 on two template bodies 1 of the two construction templates. The slider connector is configured to connect the first slider 75 and the second slider 74 together, so that the first slider 75 and the second slider 74 clamp and fix the connecting plate 622. It can be understood that by the cooperation between the two limiting cavities 744 and 745 and the two connecting plates 622 and the clamping and fixing of the two connecting plates 622 by the first slider 75 and the second slider 74, the first slider 75, the second slider 74 and the two connecting plates 622 are connected and fixed, and thus the two connecting plates 622 are fixed together, so as to finally complete the splicing between the construction templates.

As illustrated in FIG. 12, in an embodiment, in terms of the specific design of the slider connector, the slider connector includes a baffle 73, a second threaded fastener 71 and a first lock nut 72. The first slider 75 is defined with a threaded hole 752 into which a threaded rod of the second threaded fastener 71 can be screwed. The baffle plate 73 is disposed on a side of the second slider 74 facing away from the first slider 75, the baffle plate 73 is movably sleeved onto the second threaded fastener 71, and the baffle plate 73 is in contact with the second slider 74 and abuts against the second slider 74. The first lock nut 72 is threadedly sleeved onto the second threaded fastener 71, and the first lock nut 72 is configured to fasten the first slider 75 and the second slider 74 together by driving the baffle 73 to move, so that the first slider 75 and the second slider 74 can clamp and fix the connecting plate 622.

The connection principle between the construction templates is that the two construction templates to be connected are initially assembled together and two connecting groove parts 62 of the two construction templates are aligned with each other. Then, the first slider 75 and the second slider 74 are respectively placed between the two connecting groove parts 62, so that the first slider 75 and the second slider 74 are respectively located at two opposite sides of two corresponding connecting plates 622 of the two connecting groove parts 62. Then, the baffle 73 is placed on a side of the second slider 74 facing away from the first slider 75, and the second threaded fastener 71 with the first lock nut 72 passes through the baffle 73 and the second slider 74 in turn and is screwed with the threaded hole 752 on the first slider 75. Then, the first lock nut 72 is rotated, so that the first lock nut 72 drives the baffle 73 to move until the first slider 75 and the second slider 74 are firmly connected together. In a situation that the first slider 75 and the second slider 74 are firmly connected together, the two connecting plates 622 are respectively confined in the two limiting cavities 744 and 745 formed between the first slider 75 and the second slider 74. Further, when the first slider 75 and the second slider 74 are firmly connected together, the two connecting plates 622 can also be clamped and fixed, and finally the splicing connection between the two construction templates can be realized.

In an embodiment, a head portion of the second threaded fastener 71 of the connecting component 7 is designed to extend out of the protective plate 11; and the head portion of the second threaded fastener 71 and the part of the fixing rod 5 extending out of the protective plate 11 are together connected with the concrete-poured floor, so as to further improve the connection reliability.

Figure 13:
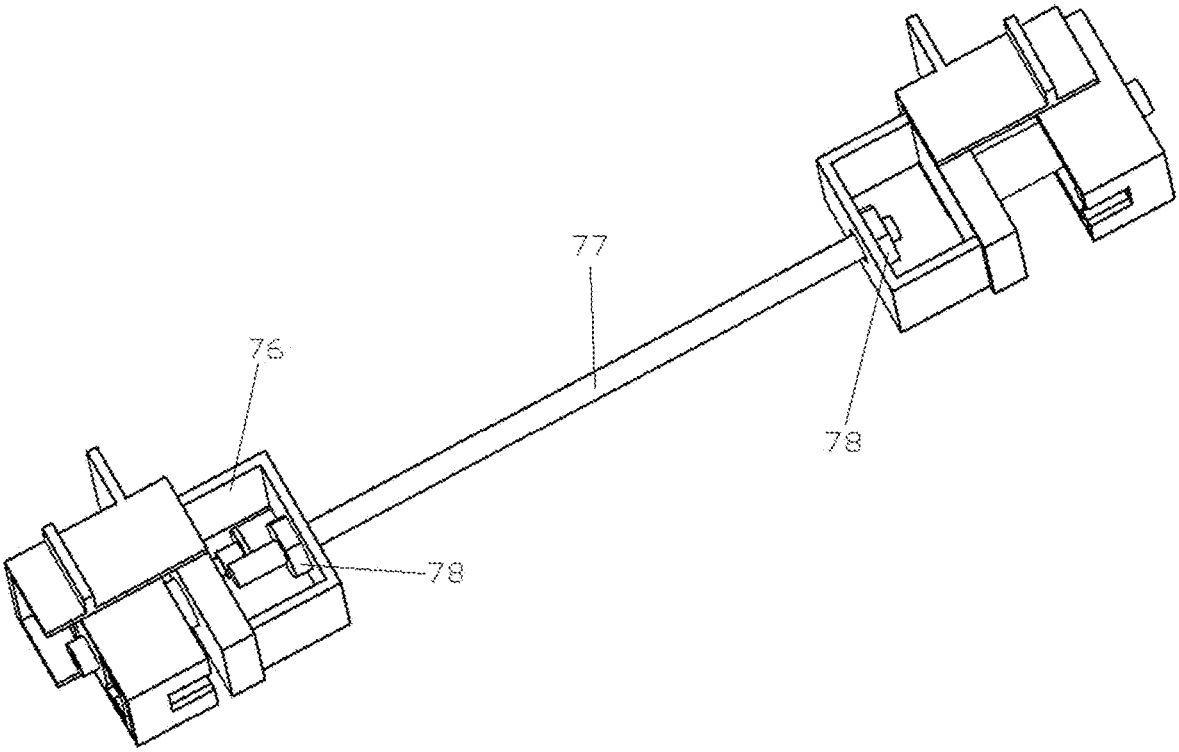
FIG. 13 illustrates a schematic structural view of a component connector for connecting two connection components of construction templates as special templates for wall connection according to an embodiment of the disclosure.

As illustrated in FIG. 13, in an embodiment, for the connection between special templates for wall connection, in order to realize the pull connection between the special templates for wall connection, the disclosure further provides a component connector. The component connector is configured to connect two connecting components 7 together. The two connecting components 7 can be designed to include a first connecting component and a second connecting component. The component connector is used for connecting the first connecting component and the second connecting component.

As illustrated in FIG. 13, the component connector further includes a third threaded fastener 77 and two second lock nuts 78.

A surface of the first slider 75 facing away from the second slider 74 is provided with a fastener connecting part 76, which is defined with a connecting cavity 761, and the fastener connecting part 76 is defined with a connecting hole 762 connected with the connecting cavity along a direction from the first slider 75 to the second slider 74. Two ends of the third threaded fastener 77 can respectively extend into the two connecting cavities through the two connecting holes. The two second lock nuts 78 are respectively threadedly sleeved onto the two ends of the third threaded fastener 77. The two second lock nuts 78 are located in the two connecting cavities. The two second lock nuts 78 are in contact with the two fastener connecting parts and abut against the two fastener connecting parts 76. Each fastener connecting part 76 can be a U-shaped structure, and the arrangement of the connecting cavities is convenient for the subsequent fastening operation of the second lock nuts 78. As for the third threaded fastener 77, it can be a double-headed screw, which is not limited herein.

In an embodiment, as illustrated in FIG. 11 and FIG. 12, the first slider 75 is covered with a fifth elastic damping material layer 45 which is in contact with the connecting groove part 62 and the connecting plate 622, and the second slider 74 is covered with a sixth elastic damping material layer 46 which is in contact with the connecting groove part 62. The first slider 75 and the second slider 74 are wrapped by elastic damping material layers, so that the first slider 75 and the second slider 74 have the function of isolating vibration waves.

The materials used to prepare the damping structures such as the elastic dampers and the damping material layers involved in the disclosure can be rubber, foamed rubber, or foamed polyurethane, which is not limited herein.

Further, in an embodiment, as illustrated in FIG. 12, the first slider 75 is provided with a protruding column 751, and the threaded hole 752 is defined in the protruding column 751. Specifically, the first slider 75 can have a convex structure, that is to say, the protruding column 751 is disposed on a block structure, which is not limited herein.

The second slider 74 may also have a square shape with a through cavity, and two side positions of the through cavity relative to the protruding column 751 are respectively provided with limit ribs 741, which are disposed along an axial direction of the protruding column 751. Each of the limit ribs 741 has an inclined plane 743 and a plane 742, and the plane 742 is connected with the inclined plane 743 and parallel to a central axis of the protruding column 751. A guide space gradually narrowing from the first slider 75 to the second slider 74 is enclosed among the inclined planes 743. The two limiting cavities 744 and 745 are defined between the planes 742 of the limit ribs 741 and the protruding column 751. In the disclosure, the first slider 75 and the second slider 74 are sequentially arranged along a direction from the base plate 12 to the protective plate 11, and a specific structure of each limit rib 741 is a right-angled trapezoidal structure, and the number of the limit ribs 741 can be four, which are symmetrically distributed in pairs, and the specific number thereof is not limited herein. The guide space can be formed among inclined planes 743, so that a part of the connecting plate 622 can better extend into the corresponding limiting cavity 744 of the two limiting cavities 744 and 745 formed between the plane 742 and the protruding column 751 through the guide space, and this design can also prompt a installation direction of the second slider 74.

Figure 14:
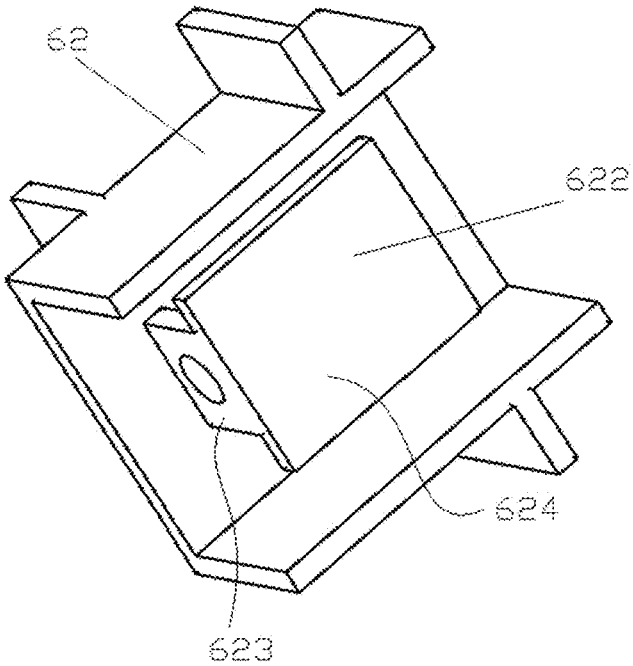
FIG. 14 illustrates a schematic perspective view of a connecting groove part of a construction template according to an embodiment of the disclosure.

As illustrated in FIG. 14, in an embodiment, the connecting plate 622 is designed to be elastically deformable, that is, the connecting plate 622 is designed to have a certain elasticity, so that the connecting plate 622 also has a certain damping effect on a vibration wave. A structure of the connecting plate 622 can be L-shaped. That is to say, the connecting plate 22 consists of a first plate part 623 connected with the connecting groove part 62 and a second plate part 624 connected with the first plate part 623. The second plate part 624 extends into the limiting cavity 744 and is limited by the limiting cavity 744, and the first plate part 623 is clamped by the first slider 75 and the second slider 74, thereby realizing the connection among the connecting plate 622, the first slider 75 and the second slider 74.

Figure 15:
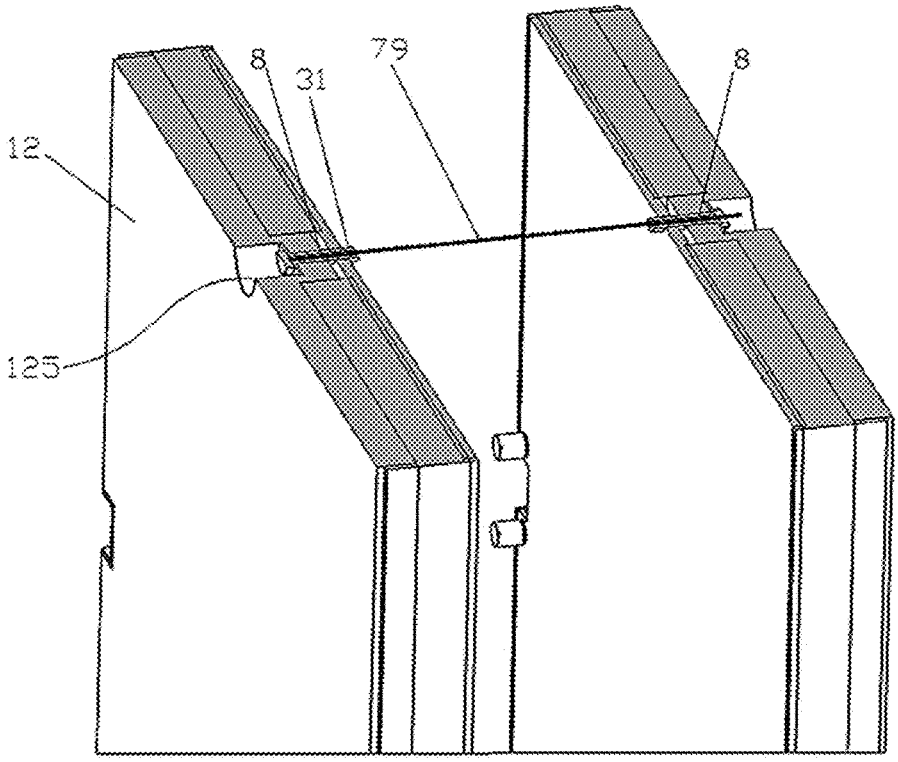
FIG. 15 illustrates a schematic partial structural view showing construction templates as special templates for floor connection connected by a vibration isolation tie rod.

As illustrated in FIG. 15, in an embodiment, for the design of a special template for wall connection, the disclosure provides a vibration isolation tie rod 79.

An end of the vibration isolation tie rod 79 passes through a protective plate 11 of a template body 1 of one construction template and is connected with a base plate 12 of the template body 1, and another end of the vibration isolation tie rod 79 passes through a protective plate 11 of a template body 1 of another construction template and is connected with a base plate 12 of the another construction template. The difference in the setting mode of the fixing rod 5 of the special template for floor connection lies in that two template bodies 1 are directly connected by setting the vibration isolation tie rod 79, so that the vibration isolation tie rod 79 can be connected with the concrete-poured floor while connecting the two template bodies 1, thereby realizing the fixing between the two construction templates and the concrete-poured floor. It can be understood that the vibration isolation tie rod 79 is used instead of the fixing rod 5, and at the same time, a T-shaped vibration isolation sleeve 8, which is also made of an elastic damping material and through which the vibration isolation tie rod 79 passes, is additionally arranged. Specifically, a groove 125 is formed on a side of the base plate 12 facing away from the protective plate 11. A bottom of the base plate 12 at the groove 125, the sound insulation material layer 2 and the protective plate 11 are provided with corresponding holes for the vibration isolation tie rod 79 to pass through. A tube portion of the T-shaped vibration isolation sleeve 8 passes through the base plate 12, the sound insulation material layer 2 and the protective plate 11 in turn, and a bottom portion of the T-shaped vibration isolation sleeve 8 is in contact with a bottom of the groove 125 and abuts against the bottom of the groove 125. The tube portion of the T-shaped vibration isolation sleeve 8 also partially passes through the protective plate 11 to achieve a better sealing effect. The vibration isolation tie rod 79 can be a bolt, a head portion of the vibration isolation tie rod 79 is in contact with the bottom of the T-shaped vibration isolation sleeve 8 on the bottom of one groove 125, and an end of a rod portion of the vibration isolation tie rod 79 passes through a base plate to reach the bottom of another groove 125 and is fastened by a nut. Of course, the vibration isolation tie rod 79 can also be a double-headed screw, and both ends thereof can be fastened by nuts at this time, which is not limited herein.

Figure 16:
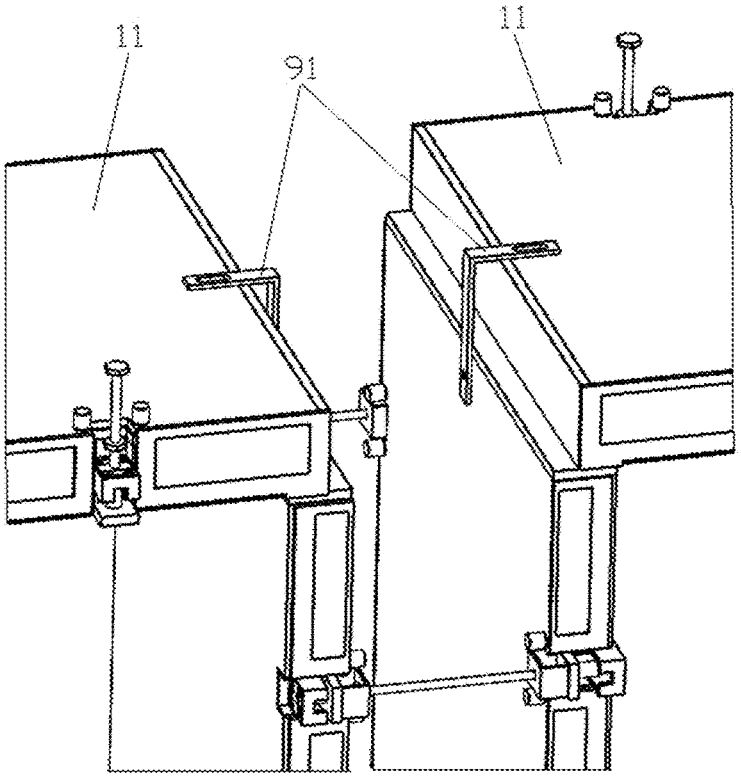
FIG. 16 illustrates a schematic second partial structural view of construction templates, which are combined with no concrete poured to the construction templates, according to an embodiment of the disclosure.

As illustrated in FIG. 16, in an embodiment, the disclosure provides a fixing corner plate 91 for realizing the lap between two vertical construction templates. In order to realize the connection between the fixing corner plate 91 and the vertical construction templates, a hole, for connecting a protective plate 11 of each of the vertical construction templates and the fixing corner plate 91, can be defined on a position of the protective plate 11 near a wall isolation side.

Figure 17:
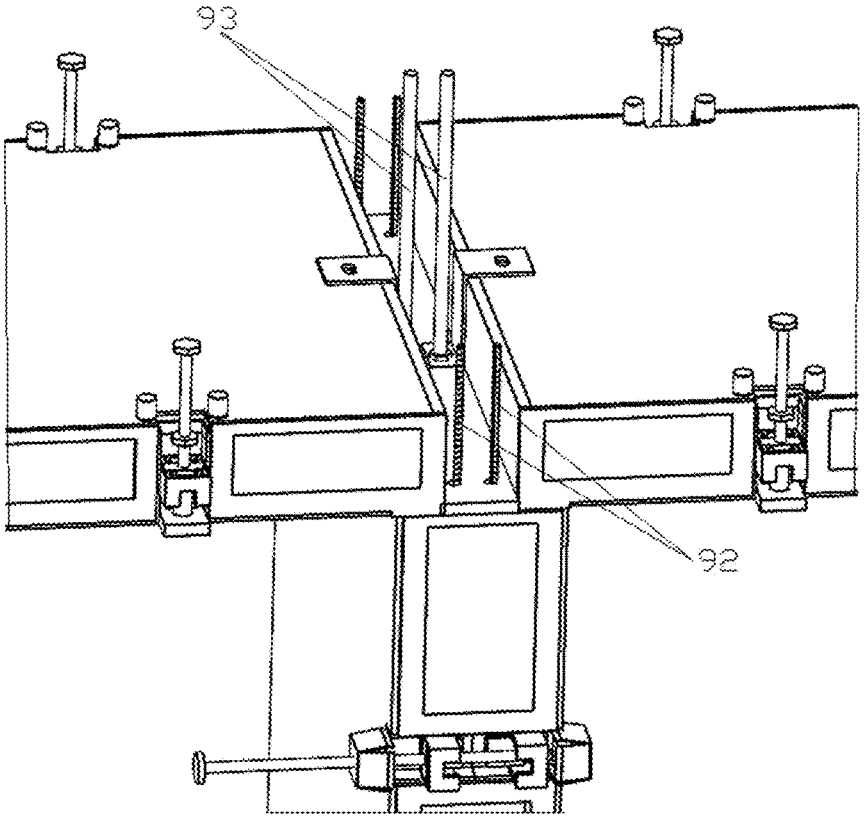
FIG. 17 illustrates a schematic partial structural view of construction templates, which are combined with no concrete poured to the construction templates, according to an embodiment of the disclosure.

As illustrated in FIG. 17, it is another overlapping schematic view of the construction templates of the disclosure, in which the two construction template located above are special templates for floor connection and the construction template located below is a light wall template matched with special templates for floor connection.

Figure 18:
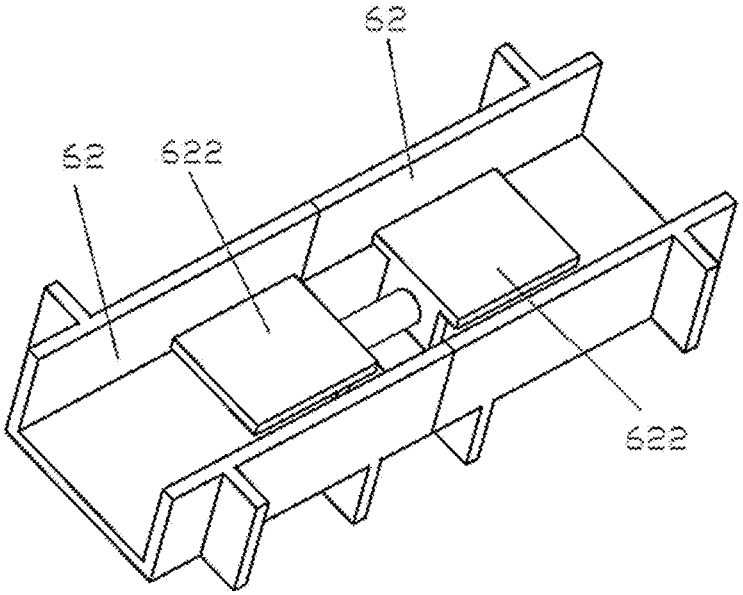
FIG. 18 illustrates a schematic connecting view of two connecting groove parts of a construction template as a light wall template according to an embodiment of the disclosure.

The design difference between the lower construction template and the upper construction template lies differences in the protective plates 11 and the connection difference between the protective plate 11 and the base plate 12. The protective plate 11 of the lower construction template has the same structure as the base plate 12 of the lower construction template, that is, the template body 1 of the lower construction template is composed of two base plates 12. Therefore, the connection mode between these two base plates 12 is different from that between the protective plate 11 and the base plate 12 of the upper construction template. Because there are two base plates 12 of the lower construction template, the connection can be made with reference to the design of the aforementioned connecting component 7, and the connection between the two base plates 12 can be realized by connecting two connecting groove parts 62 on the two base plates 12 together. As illustrated in FIG. 18, the specific connection method for the two base plates 12 is as follows. Firstly, glue adhesive is applied to butting surfaces of the two base plates 12. Then, a first threaded fastener 61 passes through two holes of two connecting plates 622 on the two corresponding connecting groove parts 62, and the holes can be set on the first plate parts 623 of the two connecting plates 622, which is not limited herein. Then, a threaded end of the first threaded fastener 61 passing through the two holes is locked by a nut, thereby completing the connection between the two connecting plates 622 and the connection between the base plates 12. When the light wall template is used together with the special template for floor connection, the position where the light wall template overlaps with the special template for floor connection is also provided with strengthened connection steel bars 92 and wall positioning bolts 93, which are embedded in concrete to strengthen the integrated connection with the floor.

The construction templates provided by the disclosure have been introduced in detail above. For the skilled in the art, there will be some changes in the specific implementation and application scope according to the concepts of the embodiments of the disclosure. In summary, the contents of this specification should not be understood as limitations to the disclosure.

What is claimed is:

1. A construction template, comprising: a template body, a sound insulation material layer, and an elastic damping device;

wherein the template body comprises a base plate and a protective plate arranged in a thickness direction of the template body, and the protective plate is connected with the base plate;

wherein the sound insulation material layer is disposed between the base plate and the protective plate;

wherein the elastic damping device is at least partially disposed between the base plate and the protective plate, and the elastic damping device is configured to support the protective plate and make a gap be formed between the protective plate and the sound insulation material layer;

wherein a top surface of the base plate facing towards the protective plate is provided with a fixing rod, and the fixing rod passes through the top surface;

wherein a part of a rod segment of the fixing rod extends beyond the protective plate;

wherein the top surface of the base plate is provided with a boss, and a part of the fixing rod is disposed in the boss;

wherein the elastic damping device comprises a first elastic damper, the first elastic damper is disposed on the boss, and the fixing rod passes through the first elastic damper;

wherein the base plate is provided with a connecting seat part; the elastic damping device further comprises a second elastic damper; and the second elastic damper is disposed on the connecting seat part and is configured to support the protective plate together with the first elastic damper; and wherein the protective plate is provided with a first threaded fastener thereon; and a threaded portion of the first threaded fastener is screwed into the connecting seat part, to fasten the protective plate with the connecting seat part.

2. The construction template as claimed in claim 1, wherein at least one of a first elastic damping material layer for isolating a building wall or a second elastic damping material layer for isolating another construction template is attached to a periphery of each of the base plate and the protective plate.

3. The construction template as claimed in claim 2, wherein a part of the sound insulation material layer at a peripheral side of the sound insulation material layer is protruded from the template body; and wherein the part of the sound insulation material layer is covered by the first elastic damping material layer or the second elastic damping material layer.

4. The construction template as claimed in claim 1, wherein a bottom surface of the base plate facing away from the protective plate is defined with a shear wall lap groove at an edge of the bottom surface; and wherein a third elastic damping material layer is disposed in the shear wall lap groove.

5. The construction template as claimed in claim 1, wherein a part of the first elastic damper is protruded from the protective plate, and the part of the first elastic damper is in sealing contact with the protective plate and the fixing rod.

6. The construction template as claimed in claim 1, wherein a head portion of the first threaded fastener is covered with a fourth elastic damping material layer.

7. The construction template as claimed in claim 1, further comprising a connecting component;

wherein a connecting groove part is disposed on the base plate;

wherein a connecting plate is disposed in the connecting groove part; and wherein the connecting component is configured to connect two connecting plates on two of the template bodies of two construction templates to connect the two template bodies together.

8. The construction template as claimed in claim 7, wherein the connecting component comprises a first slider, a second slider, and a slider connector;

wherein the first slider is slidably disposed in the connecting groove part and located at a side of the connecting plate;

wherein the second slider is slidably disposed in the connecting groove part and located at another side of the connecting plate;

wherein two limiting cavities are defined between the first slider and the second slider, to limit positions of parts of the two connecting plates, respectively; and wherein the slider connector is configured to connect the first slider and the second slider together, to thereby make the first slider and the second slider clamp and fix the connecting plate.

9. The construction template as claimed in claim 8, wherein the slider connector comprises: a baffle, a second threaded fastener, and a first lock nut;

wherein the first slider is defined with a threaded hole, and a threaded rod of the second threaded fastener is screwed into the threaded hole;

wherein the baffle is disposed at a side of the second slider facing away from the first slider, the baffle is movably sleeved onto the second threaded fastener, and the baffle is in contact with the second slider and abuts against the second slider; and wherein the first lock nut is threadedly sleeved onto the second threaded fastener; and the first lock nut is configured to fasten the first slider and the second slider together by driving the baffle to move, to thereby make the first slider and the second slider clamp and fix the connecting plate.

10. The construction template as claimed in claim 9, further comprising a component connector; and wherein the component connector is configured to connect the two connecting components together.

11. The construction template as claimed in claim 10, wherein the component connector further comprises a third threaded fastener and two second lock nuts;

wherein a surface of the first slider facing away from the second slider is provided with a fastener connecting part;

wherein the fastener connecting part is defined with a connecting cavity;

wherein the fastener connecting part is defined with a connecting hole, and the connecting hole is connected with the connecting cavity along a direction from the first slider to the second slider;

wherein two ends of the third threaded fastener are disposed to respectively extend into corresponding two connecting cavities of the two connecting components through corresponding two connecting holes of the two connecting components; and wherein the two second lock nuts are threadedly sleeved onto the two ends of the third threaded fastener, respectively; the two second lock nuts are located in the two connecting cavities, respectively; the two second lock nuts are respectively in contact with the corresponding two fastener connecting parts; and the two second lock nuts are disposed to abut against the two fastener connecting parts.

12. The construction template as claimed in claim 9, wherein the first slider is covered with a fifth elastic damping material layer, and the fifth elastic damping material layer is in contact with the connecting groove part and the connecting plate; and wherein the second slider is covered with a sixth elastic damping material layer, and the sixth elastic damping material layer is in contact with the connecting groove part.

13. The construction template as claimed in claim 9, wherein the first slider is provided with a protruding column thereon;

wherein the protruding column is defined with the threaded hole;

wherein the second slider is internally defined with a through cavity, two side positions in the through cavity relative to the protruding column are respectively provided with limit ribs, and the limit ribs are disposed along an axial direction of the protruding column;

wherein each of the limit ribs has an inclined plane and a plane, and the plane is connected with the inclined plane and is parallel to a central axis of the protruding column;

wherein a guide space is defined between the inclined planes of the limit ribs, and the guide space gradually narrows from the first slider to the second slider; and wherein the two limiting cavities are defined between the planes of the limit ribs and the protruding column.

14. The construction template as claimed in claim 9, wherein the connecting plate is elastically deformable.

15. The construction template as claimed in claim 1, further comprising a vibration isolation tie rod;

wherein an end of the vibration isolation tie rod passes through the protective plate of the template body of the construction template and is connected with the base plate of the template body; and wherein another end of the vibration isolation tie rod passes through a protective plate of a template body of another construction template and is connected with a base plate of the another template body.

16. A construction template, comprising: a template body, a sound insulation material layer, and an elastic damping device;

wherein the template body comprises a base plate and a protective plate arranged in a thickness direction of the template body, and the protective plate is connected with the base plate;

wherein the sound insulation material layer is disposed between the base plate and the protective plate;

wherein the elastic damping device is at least partially disposed between the base plate and the protective plate, and the elastic damping device is configured to support the protective plate and make a gap be formed between the protective plate and the sound insulation material layer;

wherein a connecting groove part is disposed on the base plate, a connecting plate is disposed in the connecting groove part, the construction template further comprises a connecting component, and the connecting component is configured to connect two connecting plates on two of the template bodies of two construction templates to connect the two template bodies together;

wherein the connecting component comprises a first slider, a second slider, and a slider connector;

wherein the first slider is slidably disposed in the connecting groove part and located at a side of the connecting plate;

wherein the second slider is slidably disposed in the connecting groove part and located at another side of the connecting plate;

wherein two limiting cavities are defined between the first slider and the second slider, to limit positions of parts of the two connecting plates, respectively; and wherein the slider connector is configured to connect the first slider and the second slider together, to thereby make the first slider and the second slider clamp and fix the connecting plate.

* * * * *